US006116607A

United States Patent [19]

Cho

[11] Patent Number: 6,116,607

[45] Date of Patent: Sep. 12, 2000

[54] DARTBOARD

[76] Inventor: Kun Lin Cho, 17 Alley 1, Lane 43, Tapeng Road, Taichung, Taiwan

[21] Appl. No.: 09/247,840

[22] Filed: Feb. 11, 1999

[30] Foreign Application Priority Data

Sep. 9, 1998 [TW] Taiwan ..... 87214979

[51] Int. Cl.[7] ..... F91J 5/04

[52] U.S. Cl. ..... 273/371; 273/374; 273/376

[58] Field of Search ..... 463/49–57; 273/371–372, 273/398, 403, 404, 408, 406, 407, 348

[56] References Cited

U.S. PATENT DOCUMENTS

| | | | |
|---|---|---|---|
| 4,057,251 | 11/1977 | Jones et al. | 273/376 |
| 4,561,660 | 12/1985 | Zammuto | 273/376 |
| 4,635,940 | 1/1987 | Kelley | 273/347 |
| 4,651,998 | 3/1987 | Holt et al. | 273/347 |
| 4,706,962 | 11/1987 | Michalski | 273/347 |
| 4,836,556 | 6/1989 | DeVale et al. | 273/376 |
| 4,976,441 | 12/1990 | Kim | 273/376 |
| 5,004,247 | 4/1991 | Menke | 273/376 |
| 5,116,063 | 5/1992 | Harlan et al. | 273/376 |
| 5,193,817 | 3/1993 | Pan | 273/376 |
| 5,275,418 | 1/1994 | Yiu | 273/376 |
| 5,518,250 | 5/1996 | Lu et al. | 273/347 |
| 5,560,617 | 10/1996 | Liang | 273/376 |
| 5,601,290 | 2/1997 | Yiu | 273/376 |
| 5,613,685 | 3/1997 | Stewart et al. | 273/374 |
| 5,626,344 | 5/1997 | Huang | 273/376 |
| 5,718,433 | 2/1998 | Lu et al. | 273/374 |
| 5,788,244 | 8/1998 | Hui et al. | 273/374 |
| 5,848,792 | 12/1998 | Brejcha | 273/376 |

FOREIGN PATENT DOCUMENTS

| | | | |
|---|---|---|---|
| 0495539 | 5/1984 | European Pat. Off. | 273/408 |
| 4004409 | 8/1991 | Germany | 273/408 |
| 2130107 | 5/1984 | United Kingdom | 273/376 |

*Primary Examiner*—Valencia Martin-Wallace
*Assistant Examiner*—John M. Hotaling
*Attorney, Agent, or Firm*—Connolly Bove Lodge & Hutz LLP

[57] ABSTRACT

A dartboard comprises a grid frame having sectors being provided with at least a receding guide opening at two lateral opposite sides thereof respectively; gliding plates having at least a projecting slide block extending out of two opposite lateral sides thereof respectively to slidably accommodate to said receding guide opening; soft target plates being inserted into, filled with, and fixed in the receiving recess; and a front metal grid having a rear end assembling with the front end of said grid frame.

20 Claims, 10 Drawing Sheets

DARTBOARD

BACKGROUND OF THE INVENTION

1. Field of the Invention

The present invention relates to a dartboard, particularly to a dartboard, which has improved U.S. patent application Ser. No. 08/943,261.

2. Description of Related Art

U.S. patent application Ser. No. 08/943,261 filed by the inventor discloses an electric dart game in which a plurality of gliding plates with a plurality of soft target plates are mounted on a grid frame. A main disadvantage involved in this application is that each gliding plate offers no projection rim. In case of a soft target plate being hit by a deviant dart, it is possible for the dart to result in an inclined gliding plate and to stick at a clearance between the gliding plate and the grid frame. Finally, a display on the dartboard being out of order because of a short circuit is unavoidable.

SUMMARY OF THE INVENTION

The crux of the present invention resides in that the gliding plate has a projection rim extending out of the plate itself to constitute a receiving recess for stably locating the soft target plate in the recess, and avoiding a stick dart between the gliding plate and the grid frame. In addition, the projection rim can be designed to access a steady move of the gliding plate in a sector of the grid frame. Meanwhile, an assembling job for a dartboard can be reached easily. A front metal grid is mounted on the grid frame to prevent the grid frame from damage during a metal dart shooting. A plastic grid frame is adopted to lower the gross weight and the cost of the dartboard.

The main object of the present invention is to provide a dartboard, which has a gliding plate with a projection rim so that an electronic display on the dartboard being out of order because of a stick dart is avoidable.

Another object of the present invention is to provide a dartboard, which has a well designed gliding plate to ease an assembly job for the dartboard.

A further object is to provide a dartboard, which has a gliding plate being well mounted in a sector of the grid frame and moved with the soft target plate more steadily and smoothly to enhance an accurate electronic display.

The present invention can be more fully understood by reference to the following description and accompanying drawings.

DETAILED DESCRIPTION OF THE PREFERRED EMBODIMENTS

Figure 1:
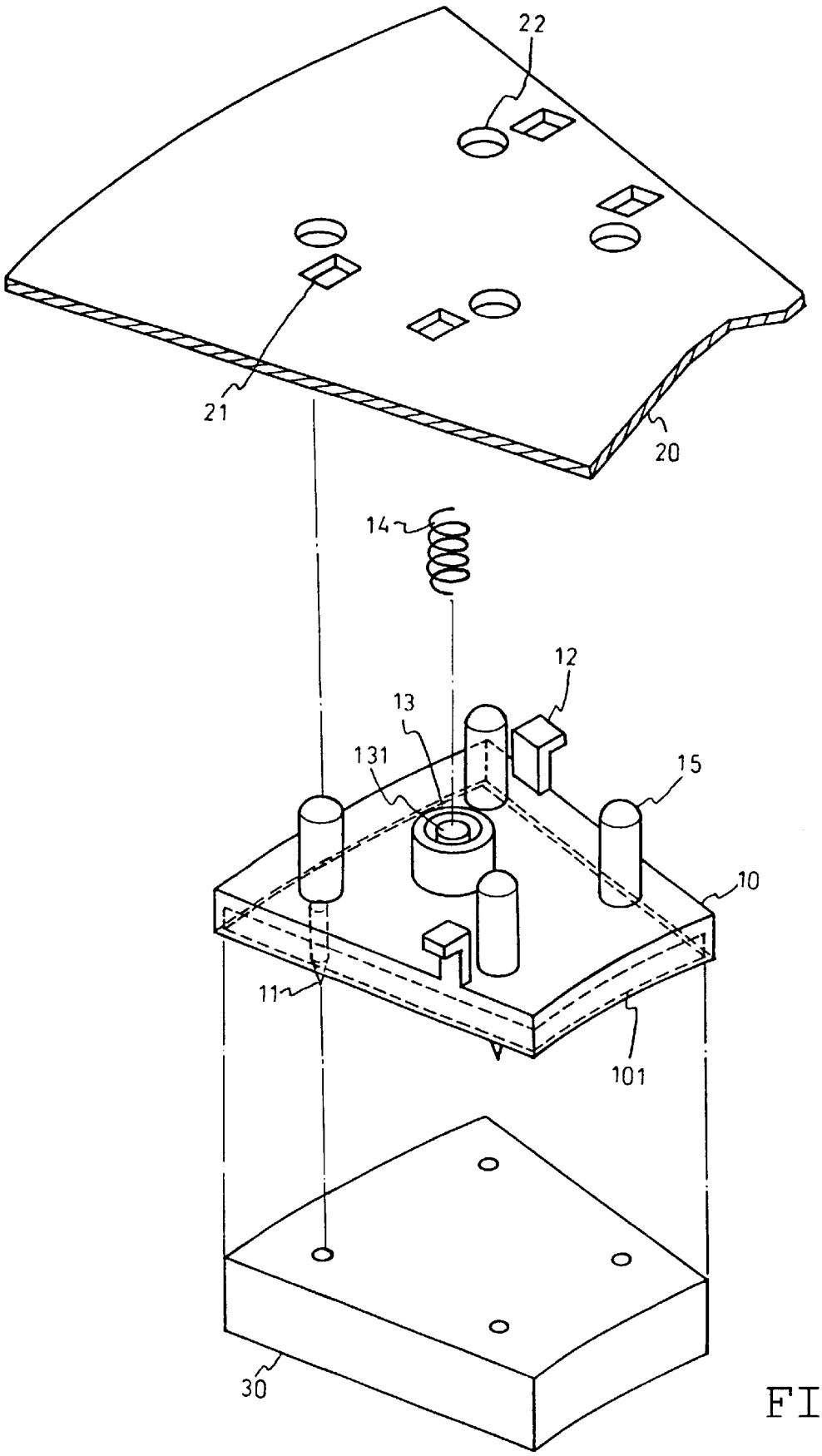
FIG. 1 is an exploded perspective view of one target sector of the present invention, with one soft plate made of stuffing, one gliding plate and part of the back plate.
Figure 2:
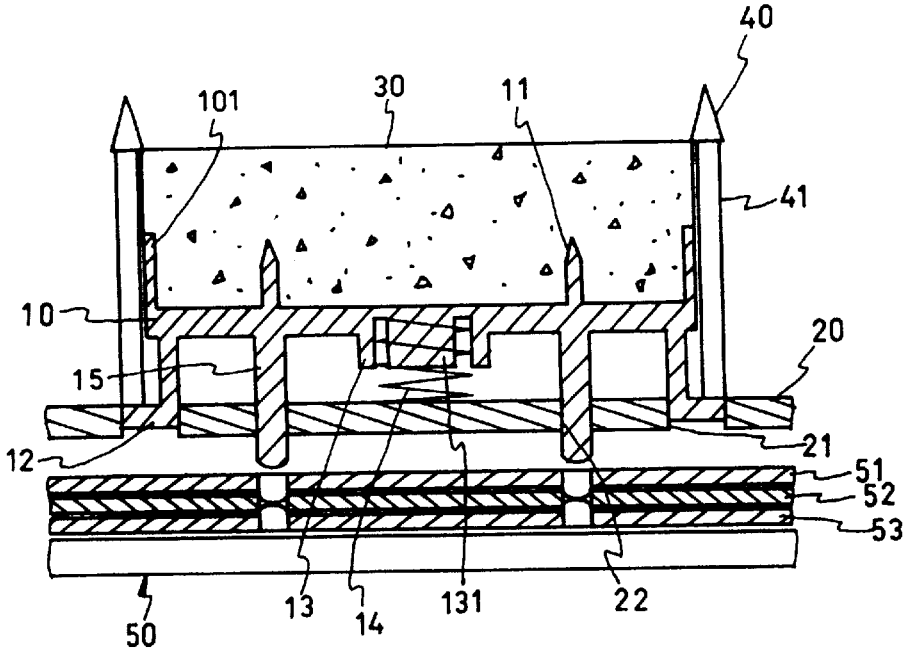
FIG. 2 is a sectional view of one target sector of the present invention.

Referring to FIGS. 1 and 2, one of a plurality of gliding plates 10 is mounted in one of a plurality of sectors in a grid frame 41. The gliding plate 10 has a projection rim to constitute a receiving recess 101 for filling with a soft target plate 30. A plurality of holding pins 11 are provided in the receiving recess 101 and inserted from the gliding plate 10 into the soft target plate 30 while the soft target plate 30 is inserted in the receiving recess 101. Besides, the gliding plate 10 and the soft target plate 30 can be held together in the receiving recess 101 by adhesive agent. The receiving recess 101 has a height lower than that of the soft target plate 30. When the soft target plate 30 is fixed in the receiving recess 101, the receiving recess 101 is concealed behind the soft target plate 30. Therefore, the gross shooting area of a dartboard can be advantageously increased and then to lessen the possibility of a metal grid on the dartboard (not shown in the figure) being hit by a shooting dart. In addition, the arrangement of the soft target plate 30 with the receiving recess 101 can avoid a dart to stick between the gliding plate 10 and the grid frame 41 in case of a deviating shoot. On the backside of the gliding plate 10, a hook 12 is provided at two opposite lateral sides thereof respectively and diagonally so that each hook 12 can be located at the lower end of the grid frame 41. A respective mounting hole 21 corresponding to each hook 12 is provided on the back plate 20 so that the hook 12 can pass through the back plate 20 freely.

The gliding plate 10 further has an accommodating opening 13 at the central position on the back side thereof with a concentric locating pin 131 for locating a spring 14 laid into the accommodating opening 13. When the gliding plate 10 is fastened to the back plate 20, the spring 14 presses on the back plate 20 to bias against the gliding plate 10 and the soft target plate 30 in the grid frame 41. In addition, contact pins 15 extend from the gliding plate 10 towards the back plate 20 corresponding to holes 22 thereon. When the soft target plate 30 is hit by a dart, the contact pins 15 enter the holes 22 to press the two membrane switches 51, 53 through holes in the insulating layer 52. Thus the membrane switches are actuated to on, giving an input signal to the microcomputer, which subsequently registers a score and issues an output to a display. After a hit by a dart, the spring 14 pushes the gliding plate 10 with the contact pins 15 leaving the two membrane switches 51, 53 and causing the membrane switches 51, 53 to off again, ready for another hit by a dart.

Figure 3:
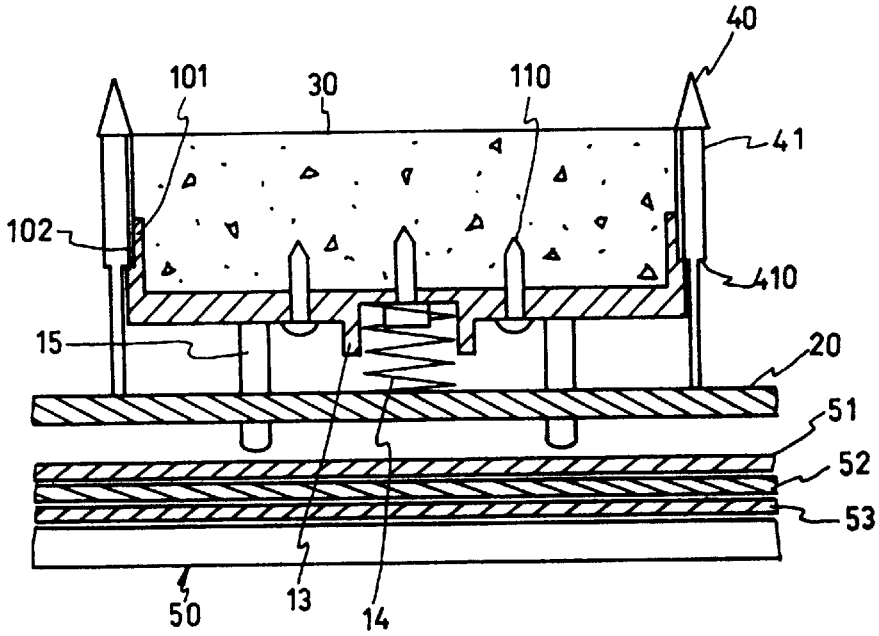
FIG. 3 is a sectional view of one target sector of the present invention in the second embodiment.

As shown in FIG. 3, the gliding plate 10 and the soft plate 30 also can be fastened together by screws 110 instead. A retaining recession 410 is provided at the lower part of the grid frame 41. Another retaining recession 102 is provided on the gliding plate 10 corresponding to the retaining recession 410 so that the gliding plate 10 can be limited to move in the grid frame 41 more steadily.

Figure 4:
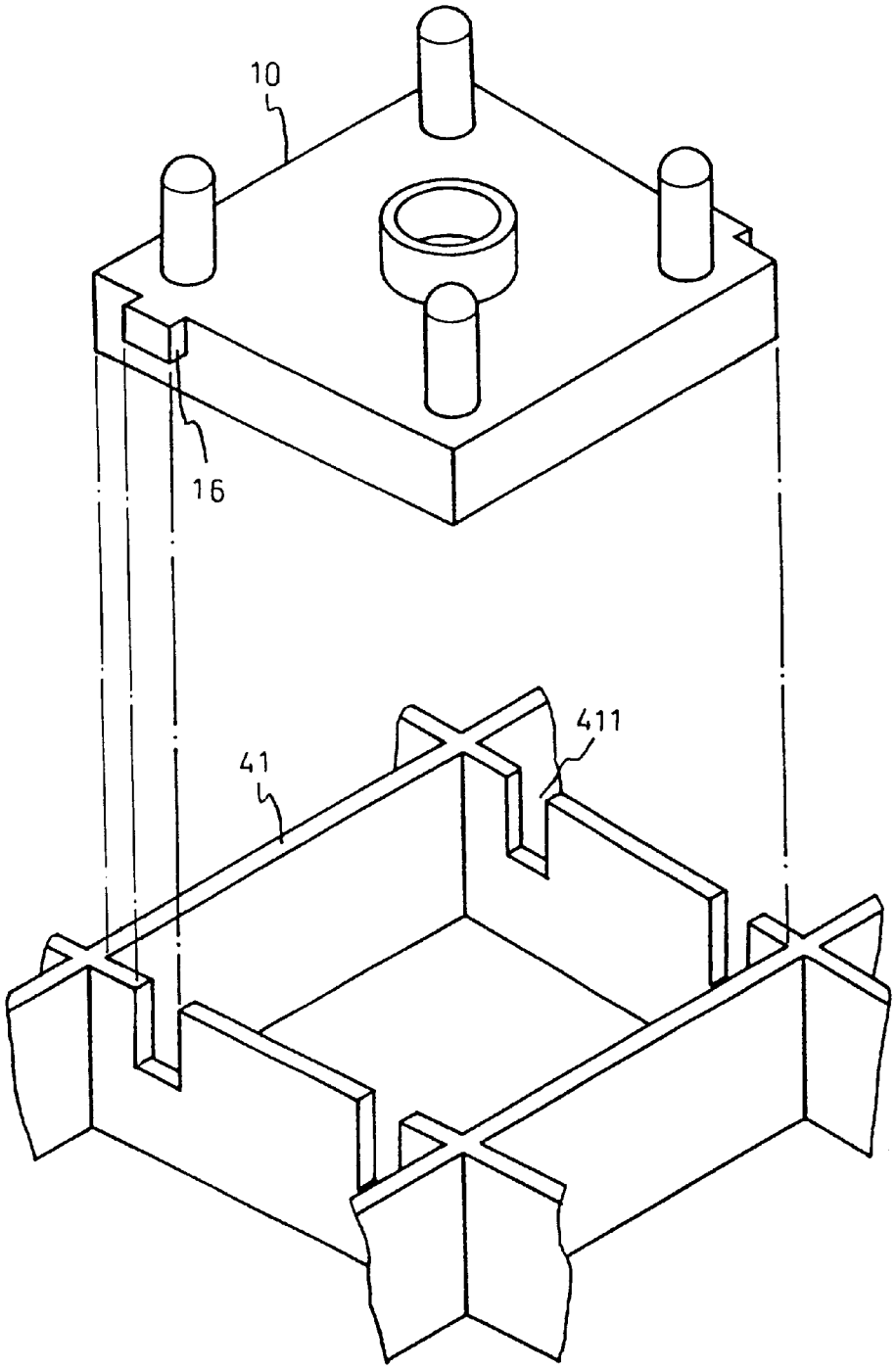
FIG. 4 is a partly fragmentary perspective view of one target sector of the present invention in the third embodiment.

As shown in FIG. 4, the gliding plate 10 can be provided with at least a projecting slide block 16 at two opposite lateral sides respectively. The grid frame 41 is provided with at least a receding guide opening 411 to slidably fit with the slide block 16. Thus, a steady and smooth move of the gliding plate 10 in the grid frame 41 can also be reached.

Figure 5:
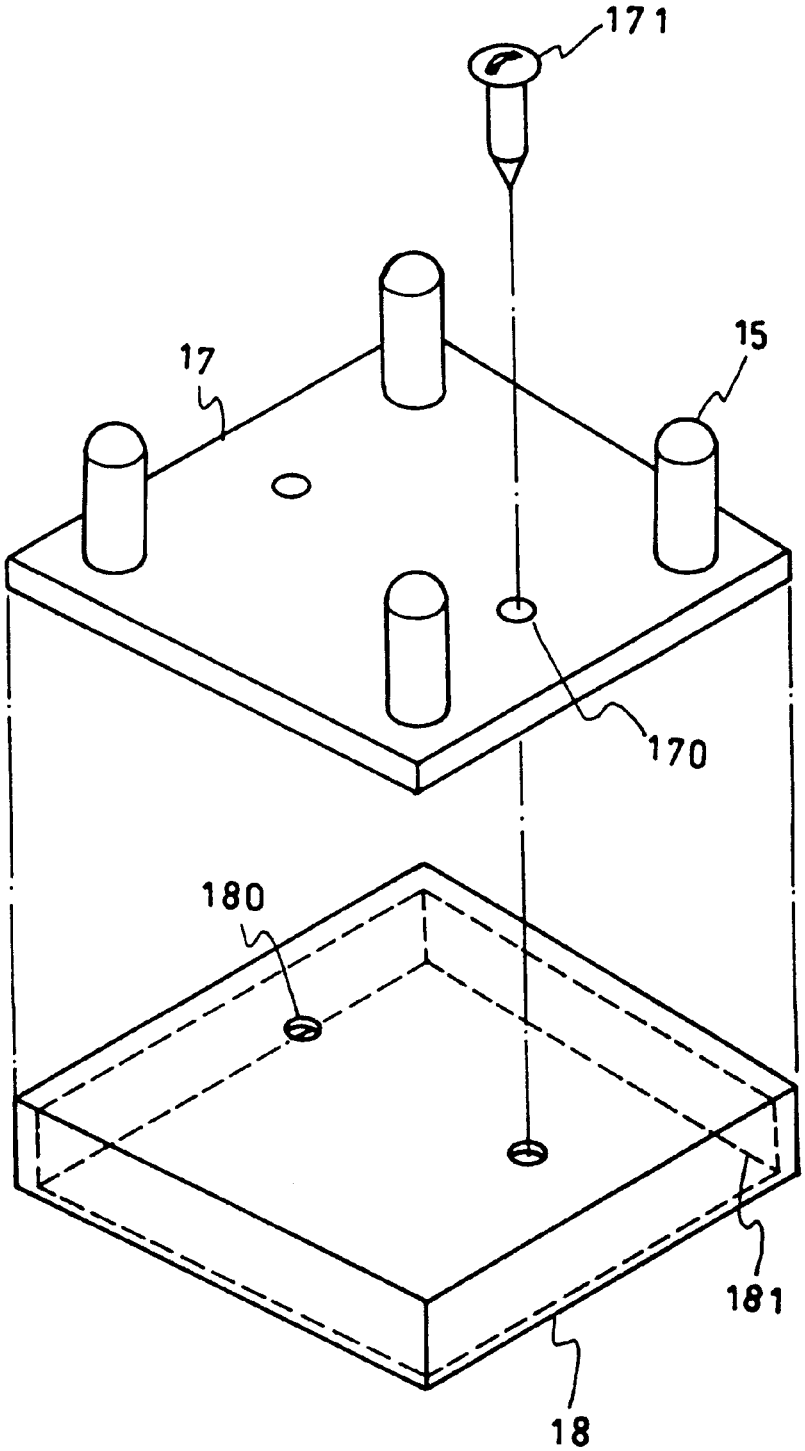
FIG. 5 is a partly fragmentary perspective view of one target sector of the present invention in the fourth embodiment.

Referring to FIG. 5, a gliding plate assembly consisting of a gliding plate part 18 and a plate seat 17 is provided instead of a single gliding plate 10. The plate seat 17 has contacting pins 15 on the backside thereof. The gliding plate part 18 has a receiving recess 181. The gliding plate part 18 can have a smaller thickness to increase the space of the receiving recess 181 if the gliding plate part is made of metal. Thus, a larger soft target plate 30 can be inserted into the receiving recess 181. In addition, the gliding plate part 18 made of metal can have a longer life even if hit by a metal dart. At least a through hole 170 is provided on the plate seat 17 and at least a through holes 180 on the gliding plate part 18 is provided to correspond to the through holes 170. Therefore, the plate seat 17, the gliding plate part 18, and the soft target plate 30 are able to be fixed together by at least the screw 171. It is noted that the gliding plate assembly has a same installation ways in a grid frame as shown in FIG. 1 to FIG. 4 and there is no further detail will be described.

Figure 6A:
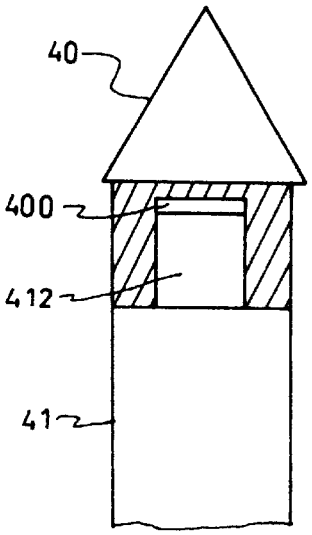
FIG. 6A is a diagrammatic view illustrating a front metal grid and a grid frame assembly in the fifth embodiment.
Figure 6B:
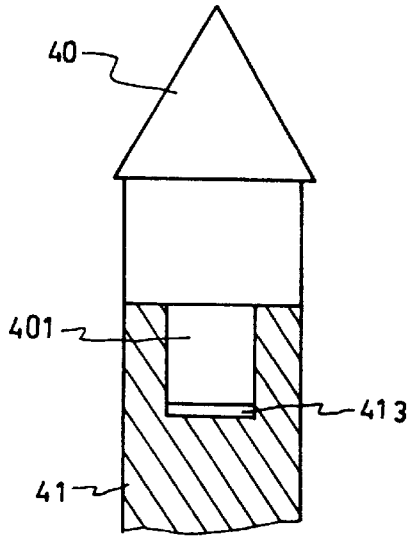
FIG. 6B and 6*c* are diagrammatic views illustrating other assemblies for a front metal grid and a grid frame similar to FIG. 6A.
Figure 6C:
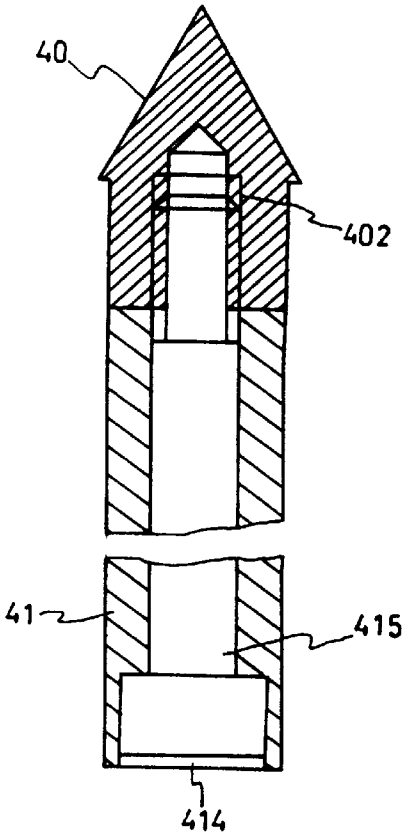

Referring to FIG. 6A, the front metal grid 40 has a groove 400 at an end for fitting with a projection part 412 on the grid frame 41 so that the front metal grid 40 and the grid frame 41 can be assembled to each other. As shown in FIG. 6B, an assembly way similar to FIG. 6A can be conducted. That is, the front metal grid 40 has a projection 401 at an end for fitting with a groove 413 on the grid frame 41. FIG. 6C shows the front metal grid 40 has a threaded hole 402 at an end and the grid frame has a through hole 414 corresponding to the threaded through hole 402 so that the front metal grid and the grid frame can be fastened together by a screw 415.

Figure 7B:
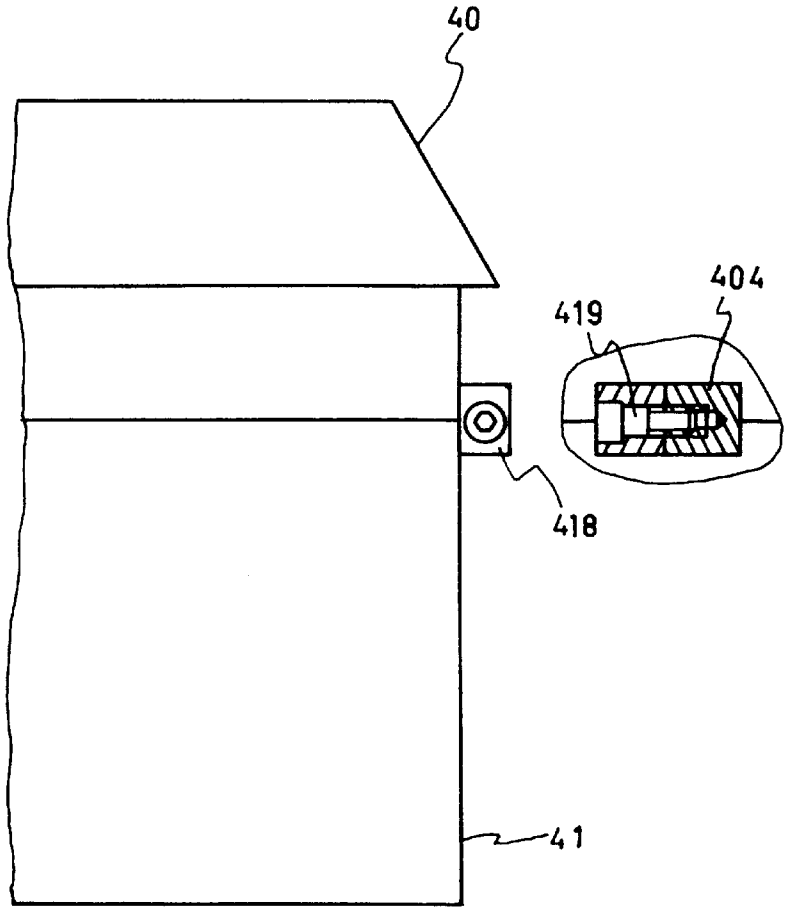
FIG. 7B is a diagrammatic view illustrating another assembly for a front metal grid and a grid frame similar to FIG. 7A.
Figure 7A:
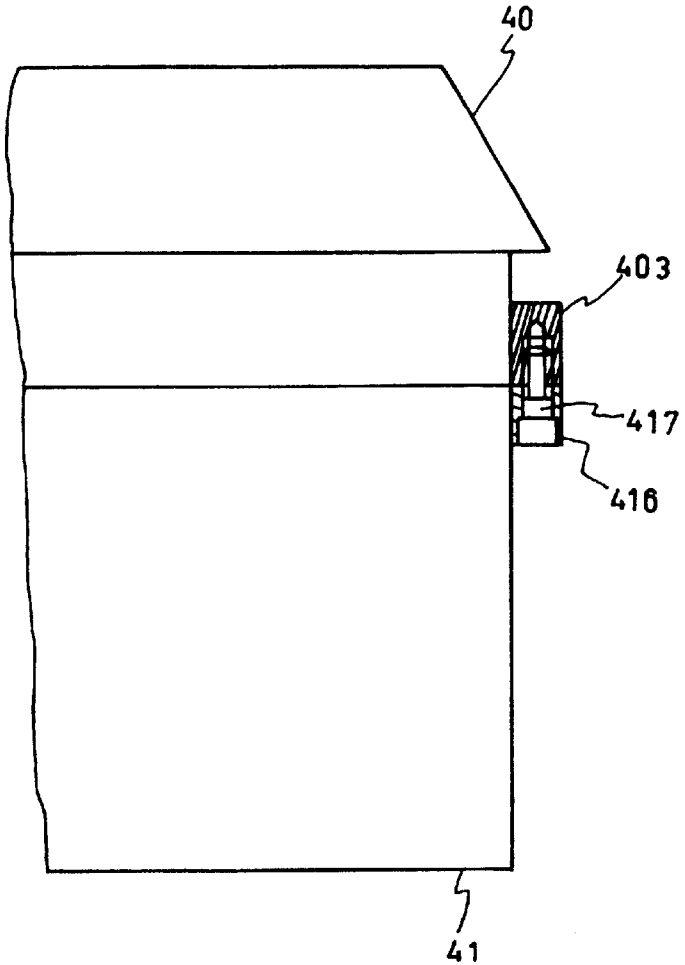
FIG. 7A is a diagrammatic view illustrating a front metal grid and a grid frame assembly in the sixth embodiment.

Referring to FIG. 7A, the metal grid 40 has a longitudinal attachment 403 with a threaded hole at an end therein and the grid frame 41 has a longitudinal attachment 416 with a through hole corresponding to the attachment 403. Thus, the front metal grid 40 and the grid frame 41 can be fixed together by a screw 417 fastening to the threaded hole via the through hole. As shown in FIG. 7B, a way similar to FIG. 7A is conducted. That is, the front metal grid 40 has a transverse attachment 404 with a threaded hole at an end thereon and the grid frame 41 has a transverse attachment 418 with a through hole corresponding to the attachment 404. Thus, the front metal grid 40 and the grid frame 41 are fixed together by a screw 419 fastening to the threaded hole via the through hole.

Figure 8:
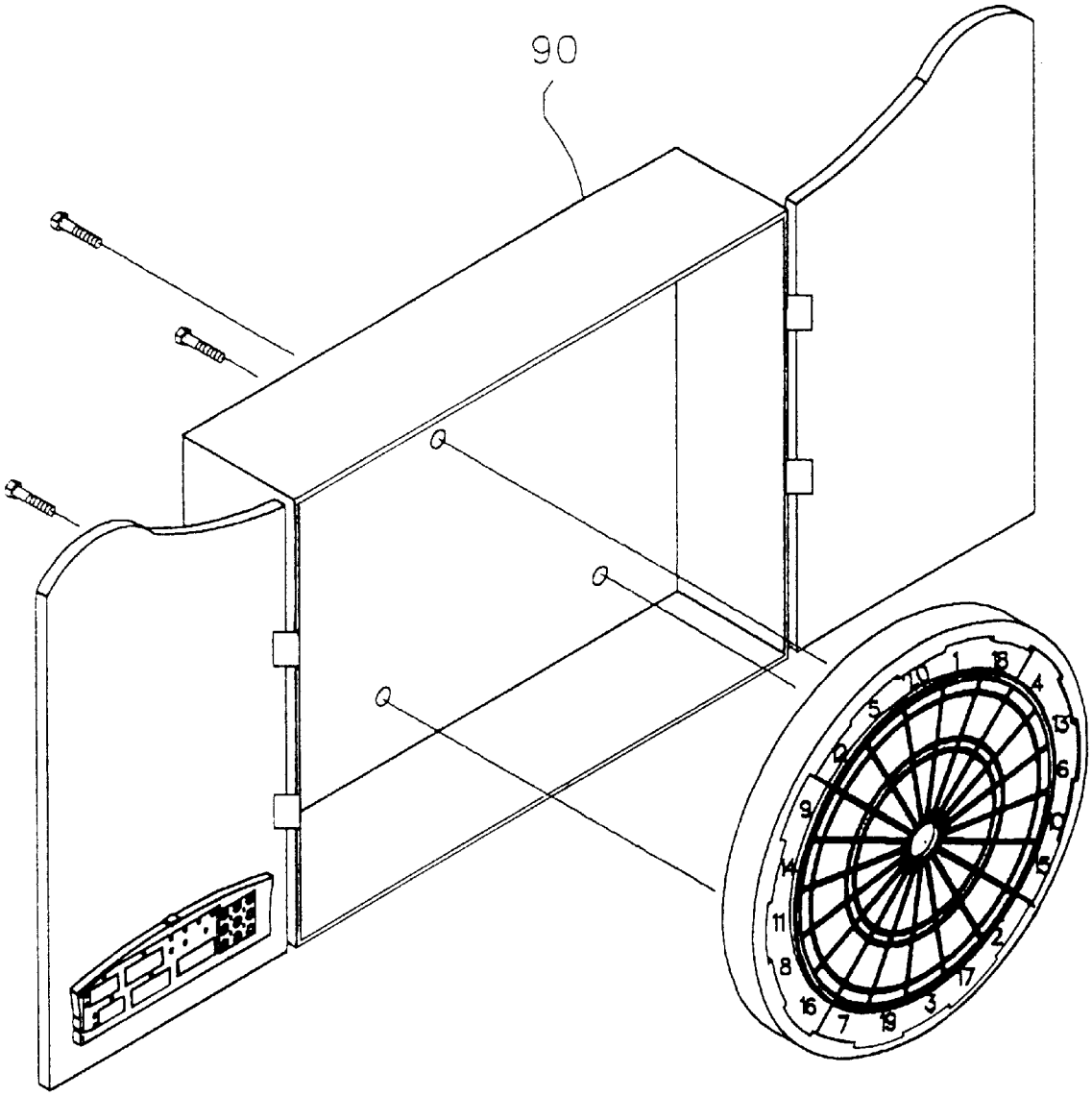
FIG. 8 is a perspective view of the dart target in the seventh embodiment before assembly.
Figure 9:
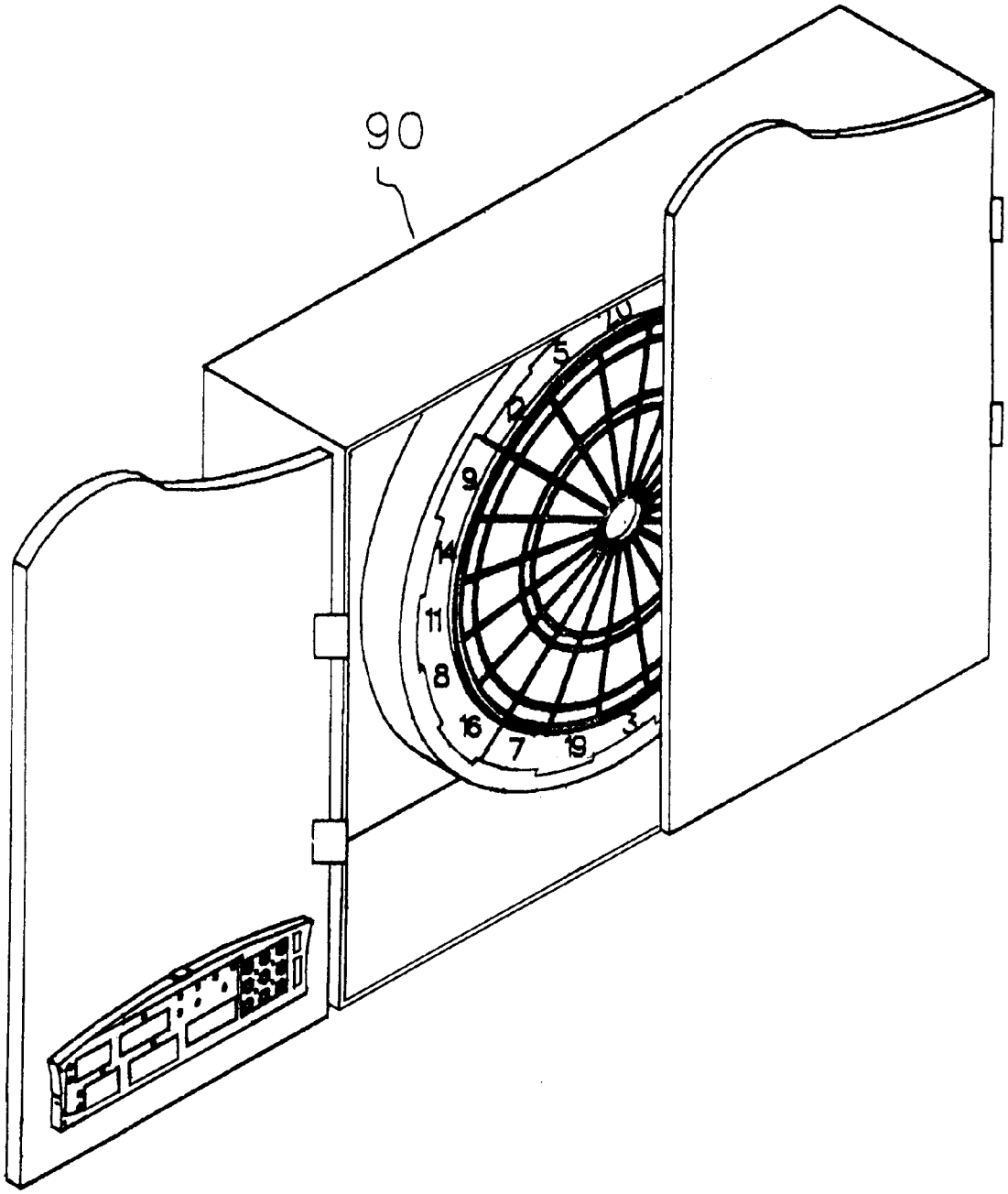
FIG. 9 is a perspective view of the dart target in the seventh embodiment after assembly.

Referring to FIGS. 8 and 9, another embodiment is illustrated that the dartboard of the present invention can be placed and attached in a shoot casing 90. When the casing is opened, the user can play the dart target without taking it out of the casing 90. Therefore, the casing 90 containing the dartboard not only provides the dartboard a convenient storage but also keeps the dartboard out of dirt easily. Furthermore, a scoring plate and ON-OFF buttons can be placed on the casing 90 nearby the dartboard.

Figure 10:
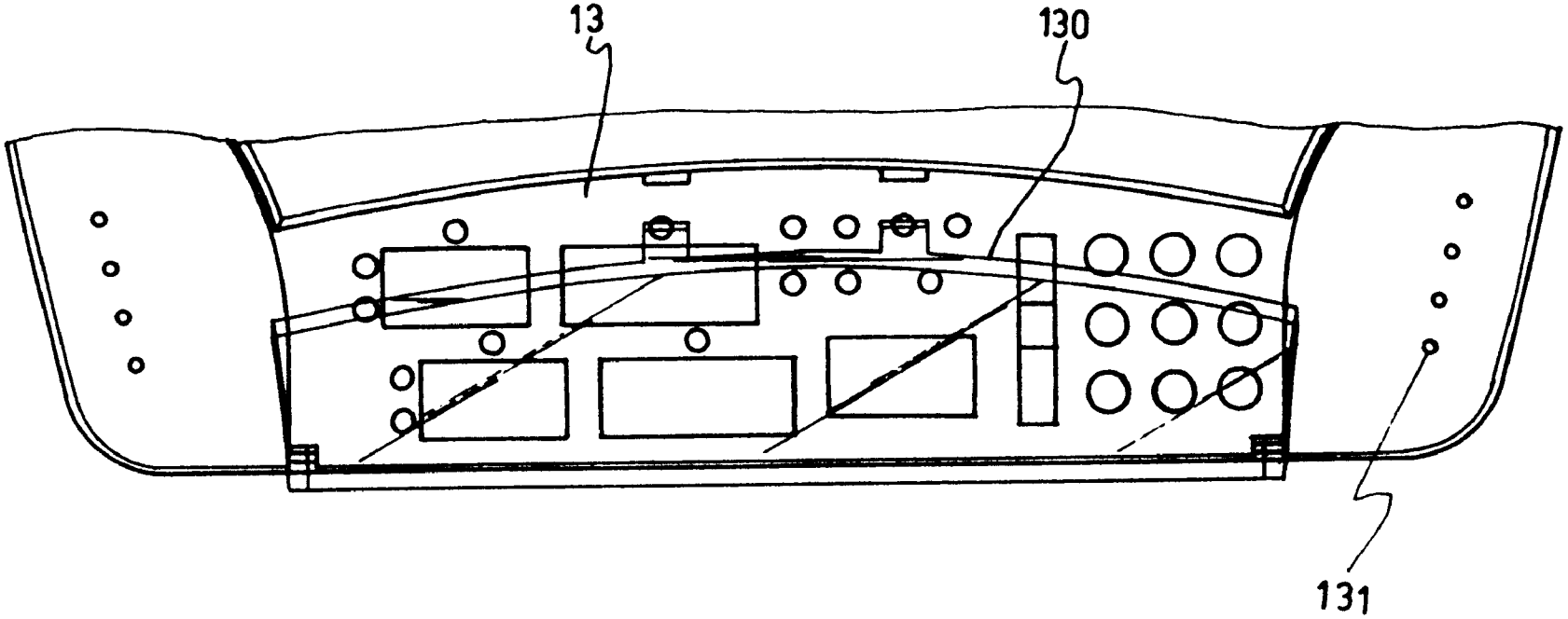
FIG. 10 is a fragmentary diagrammatic view of a scoring plate shown in FIG. 9 to illustrate a protection cover thereon.

Referring to FIG. 10, a protection cover 130 for the scoring plate is shown in the figure. The protection cover 130 is made of transparent material and designed to be able to open. The protection cover 130 can be opened before a desired shooting game is going to be selected. Then, push a button on the scoring panel to select a specific game as desired. The protection cover is then closed after the game is set such that the scoring panel can be protected from damage caused by being hit by a dart. In addition, there are holding holes 131 provided at both end parts of the scoring panel for darts.

Figure 11:
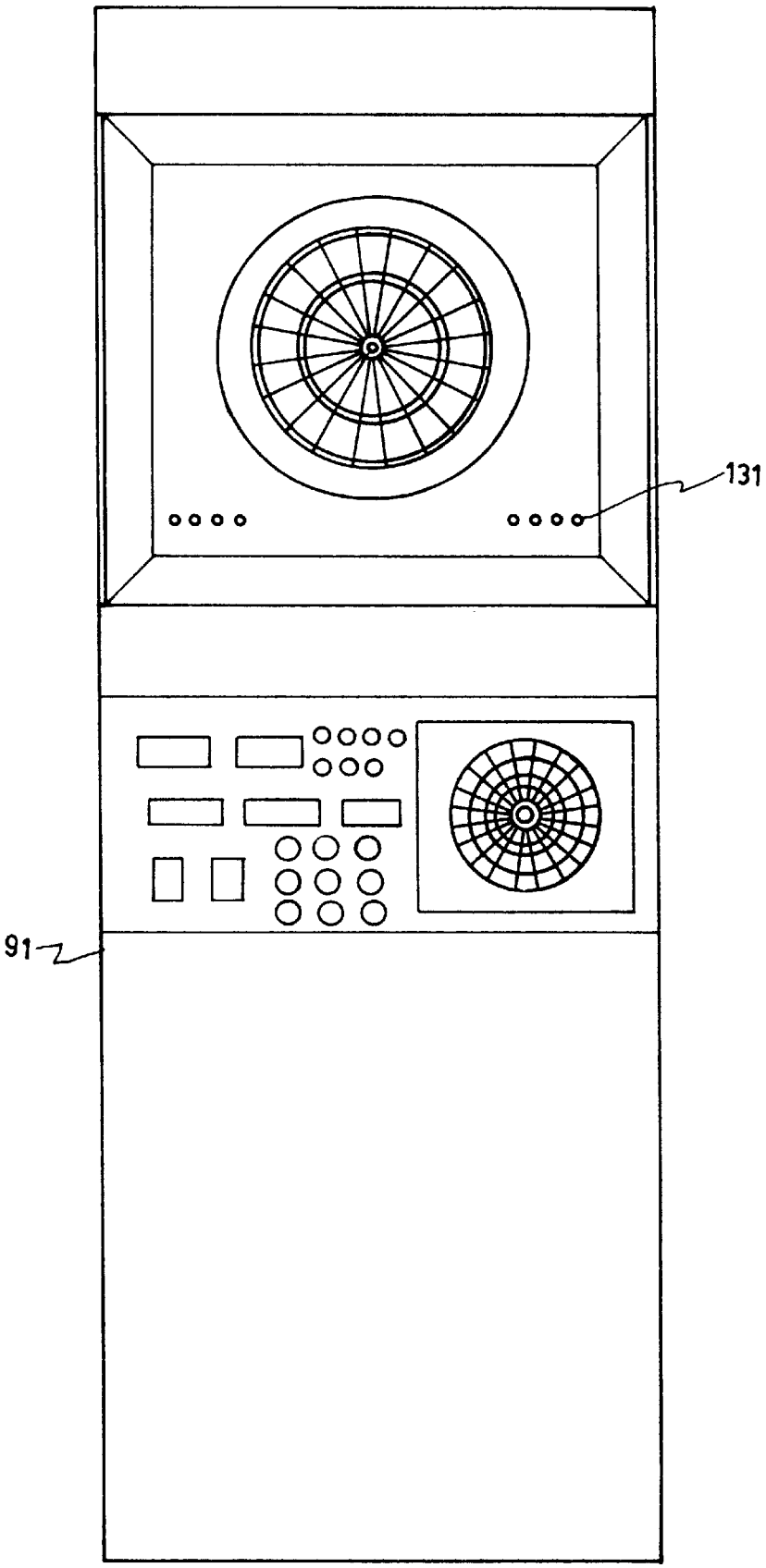
FIG. 11 is a diagrammatic view of a big game machine with a dartboard of the present invention on it.

Referring to FIG. 11, a further embodiment is illustrated. A dartboard device provided with the target plates of the invention can be mounted on a big game machine 91 such that a dart shooting game also can be played in a large entertaining game shop. Furthermore, holding holes for darts are provided around the dartboard device to be easily picked up by the users.

While the invention has been described with reference to preferred embodiments thereof, it is to be understood that modifications or variations maybe easily made without departing from the spirit of this invention defined by the appended claims.

What is claimed is:

1. A dartboard, comprising:

a grid frame, said grid frame having a front end and a rear end, and a plurality of sectors;

a rear plate fixing at the rear end of said grid;

a plurality of gliding plates, each of said plurality of gliding plates having a receiving recess;

a plurality of soft target plates, each of said plurality of soft target plates being inserted into, filled with, and fixed in said receiving recess; and a front metal grid, said metal grid having a rear end assembling with the front end of said grid frame by means of a recess part fitting with a projection part.

2. A dartboard according to claim 1, wherein each of said plurality of sectors is provided with at least a receding guide opening at two lateral opposite sides thereof respectively, and each of said plurality of gliding plates has a receiving recess and at least a projecting slide block extending out of two opposite lateral sides thereof respectively to slidably accommodate to said receding guide opening.

3. A dartboard according to claim 1, said dartboard further comprises a main body enclosing a ring plate, which has blocking incisions, with said grid frame having blocking shoulders corresponding said blocking incisions such that said grid frame is mounted by inserting said blocking shoulders in said blocking incisions and subsequent turning of said grid frame.

4. A dartboard according to claim 1, wherein said dartboard is provided with a scoring panel having a transparent protection cover.

5. A dartboard according to claim 1, wherein the grid frame is provided with a plurality of retaining recessions at the lower part thereof, and each of said plurality of gliding plates is provided with retaining recessions corresponding to said retaining recessions on the grid frame such that said gliding plate can be limited to move in the grid frame.

6. A dartboard according to claim 1, wherein each of said plurality of sectors being provided with at least a receding guide opening, and each of said plurality of gliding plates having at least a projecting slide block to slidably accommodate to said receding guide opening.

7. A dartboard according to claim 1, wherein said front metal grid has a plurality of attachments surrounding said rear end thereof and said grid frame has a plurality of attachments surrounding said front end thereof to align with the plurality of attachments on said metal grid so that each aligning pair formed by said plurality of attachments can be fastened together by a screw respectively.

8. A dartboard according to claim 1, wherein said front metal grid and said grid frame are provided with threaded holes and through holes respectively for fastening together by screws.

9. A dartboard according to claim 1, wherein said dartboard is mounted on a big game machine or in a wooden box.

10. A dart board according to claim 1, wherein at least a holding hole for a dart is provided on the dartboard at a place other than places for the score surface, the scoring panel, and the push buttons.

11. A dartboard, comprising:

a grid frame, said grid frame having a front end and a rear end, and a plurality of sectors;

a rear plate fixing at the rear end of said grid;

a plurality of gliding plate, each of said plurality of gliding plate being assembled by a plate seat, being able to be made of metal and having a receiving recess;

a plurality of soft target plates, each of said plurality of soft target plates being inserted into, filled with, and fixed in said receiving recess; and a front metal grid, said metal grid having a rear end assembling with the front end of said grid frame by means of a recess part fitting with a projection part.

12. A dartboard according to claim 11, wherein each of said plurality of sectors is provided with at least a receding guide opening at two lateral opposite sides thereof respectively, and each of said plurality of gliding plates has a receiving recess and at least a projecting slide block extending out of two opposite lateral sides thereof respectively to slidably accommodate to said receding guide opening.

13. A dartboard according to claim 11, said dartboard further comprises a main body enclosing a ring plate, which has blocking incisions, with said grid frame having blocking shoulders corresponding said blocking incisions such that said grid frame is mounted by inserting said blocking shoulders in said blocking incisions and subsequent turning of said grid frame.

14. A dartboard according to claim 11, wherein said dartboard is provided with a scoring panel having a transparent protection cover.

15. A dartboard according to claim 11, wherein the grid frame is provided with a plurality of retaining recessions at the lower part thereof, and each of said plurality of gliding plates is provided with retaining recessions corresponding to said retaining recessions on the grid frame such that said gliding plate can be limited to move in the grid frame.

16. A dartboard according to claim 11, wherein each of said plurality of sectors being provided with at least a receding guide opening, and each of said plurality of gliding plates having at least a projecting slide block to slidably accommodate to said receding guide opening.

17. A dartboard according to claim 11, wherein said front metal grid has a plurality of attachments surrounding said rear end thereof and said grid frame has a plurality of attachments surrounding said front end thereof to align with the plurality of attachments on said metal grid so that each aligning pair formed by said plurality of attachments can be fastened together by a bolt respectively.

18. A dartboard according to claim 11, wherein said front metal grid and said grid frame are provided with threaded holes and through holes respectively for fastening together by screws.

19. A dartboard according to claim 11, wherein said dartboard is mounted on a big game machine or in a wooden box.

20. A dartboard according to claim 11, wherein at least a holding hole for a dart is provided on the dartboard at a place other than places for the score surface, the scoring panel, and the push buttons.

* * * * *